US010072483B2

(12) United States Patent
Greci

(10) Patent No.: US 10,072,483 B2
(45) Date of Patent: Sep. 11, 2018

(54) EROSION RESISTANT SCREEN ASSEMBLY

(71) Applicant: HALLIBURTON ENERGY SERVICES, INC., Houston, TX (US)

(72) Inventor: Stephen Michael Greci, Little Elm, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 252 days.

(21) Appl. No.: 14/910,435

(22) PCT Filed: Oct. 15, 2013

(86) PCT No.: PCT/US2013/065024

§ 371 (c)(1),
(2) Date: Feb. 5, 2016

(87) PCT Pub. No.: WO2015/057199

PCT Pub. Date: Apr. 23, 2015

(65) Prior Publication Data

US 2016/0194941 A1 Jul. 7, 2016

(51) Int. Cl.
*E21B 43/08* (2006.01)

(52) U.S. Cl.
CPC ..... *E21B 43/08* (2013.01); *E21B 43/082* (2013.01); *E21B 43/084* (2013.01)

(58) Field of Classification Search
CPC ..... E21B 43/08; E21B 43/084; E21B 43/082
See application file for complete search history.

(56) References Cited

U.S. PATENT DOCUMENTS

| | | | | |
|---|---|---|---|---|
| 4,476,925 | A | 10/1984 | Cox | |
| 5,881,809 | A | 3/1999 | Gillespie et al. | |
| 7,762,341 | B2 * | 7/2010 | Hammer | E21B 34/08 166/187 |
| 2003/0000700 | A1 | 1/2003 | Hailey, Jr. | |
| 2004/0134656 | A1 * | 7/2004 | Richards | E21B 43/04 166/276 |
| 2008/0135249 | A1 | 6/2008 | Fripp et al. | |
| 2010/0000742 | A1 * | 1/2010 | Bonner | E21B 43/08 166/378 |
| 2010/0051262 | A1 * | 3/2010 | Dusterhoft | E21B 43/08 166/236 |
| 2012/0073801 | A1 | 3/2012 | Greci et al. | |

OTHER PUBLICATIONS

International Patent Application No. PCT/US2013/065024 , International Search Report and Written Opinion, dated Jul. 8, 2014, 13 pages.

* cited by examiner

*Primary Examiner* — Brad Harcourt
(74) *Attorney, Agent, or Firm* — Kilpatrick Townsend & Stockton LLP

(57) ABSTRACT

A sand control screen assembly can be operably positioned within a wellbore. The sand control screen assembly can include a base pipe and an unperforated shroud. The assembly can also include a filter medium positioned between the unperforated shroud and the base pipe. The base pipe and the filter medium can define an inner passageway for fluid flow along the base pipe. The filter medium and the unperforated shroud can define an outer passageway for fluid flow between the filter medium and the unperforated shroud.

20 Claims, 4 Drawing Sheets

EROSION RESISTANT SCREEN ASSEMBLY

CROSS-REFERENCE TO RELATED APPLICATIONS

This is a U.S. national phase under 35 U.S.C. § 371 of International Patent Application No. PCT/US2013/065024, titled "Erosion Resistant Screen Assembly" and filed Oct. 15, 2013, the entirety of which is incorporated herein by reference.

TECHNICAL FIELD

The present disclosure relates generally to controlling the production of particulate materials from a subterranean formation and, more particularly (although not necessarily exclusively), to a sand control screen assembly.

BACKGROUND

Various assemblies can be installed in a well traversing a hydrocarbon-bearing subterranean formation. During well drilling and completion particulate materials, such as sand, may be produced during the production of hydrocarbons from a well traversing an unconsolidated or loosely consolidated subterranean formation. Numerous problems may occur as a result of the production of such particulate materials. For example, the particulate materials cause abrasive wear to components within the well, such as tubing, flow control devices and safety devices. In addition, the particulate materials may partially or fully clog the well creating the need for an expensive workover. Also, if the particulate materials are produced to the surface, they must be removed from the hydrocarbon fluids by processing equipment at the surface.

A sand control screen assembly or screen assembly can prevent the production of particulate materials from a well that traverses a hydrocarbon bearing subterranean formation. The screen assembly can also include devices that can control the flow rate of fluid between the formation and tubing, such as production or injection tubing. An example of these devices is an inflow control device.

The particulate materials, such as sand, can flow through a filtering medium of the screen assembly proximate to the inflow control device at a high velocity. Particulate materials passing through the screen assembly at a high velocity can cause erosion and damage to the screen assembly. A screen assembly providing an even flow of particulate materials passing through the length of the screen assembly can prevent erosion of the screen assembly.

DETAILED DESCRIPTION

Figure 1:
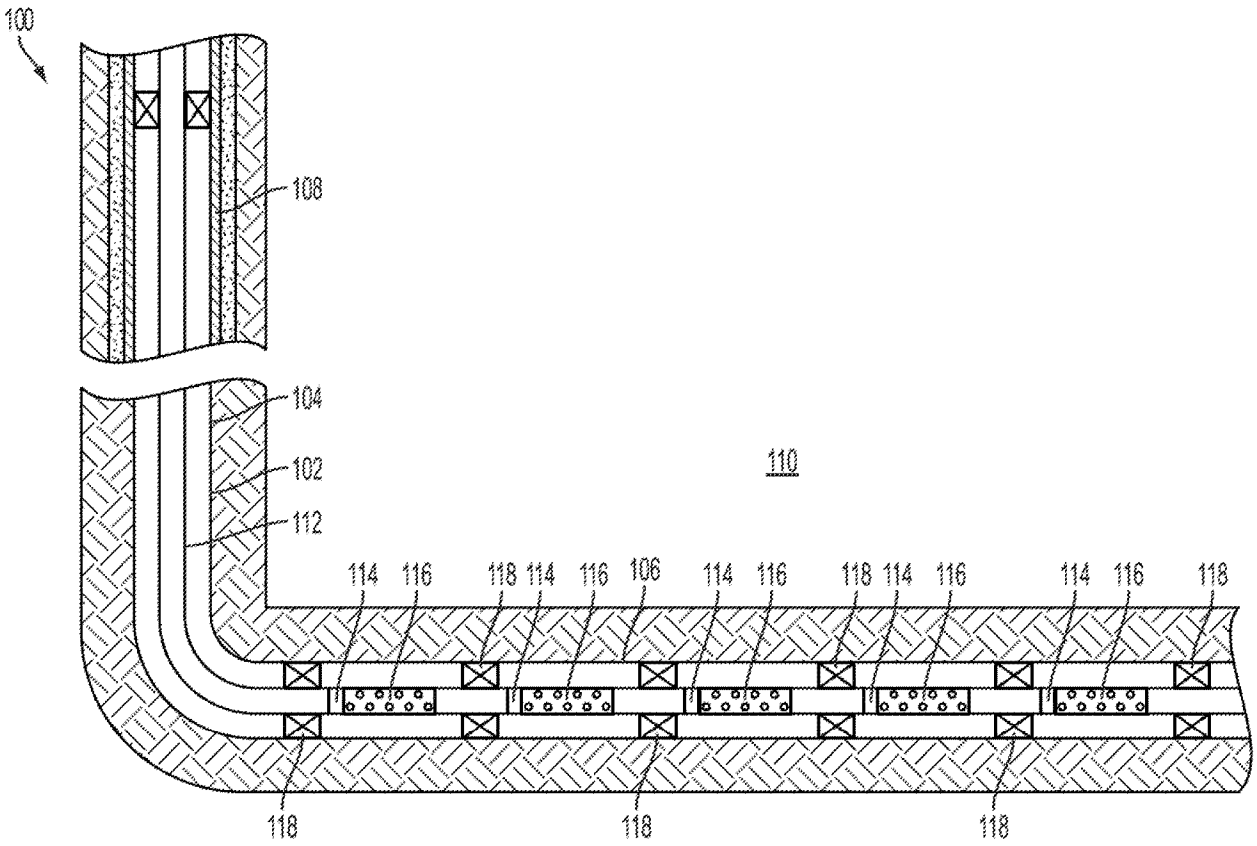
FIG. 1 is a schematic illustration of a well system having screen assemblies according to one aspect.

Certain aspects and features relate to an erosion resistant sand control screen assembly or screen assembly that may be coupled to an inflow control device. The distribution of particulate materials that flow through the screen assembly can be evenly distributed across the length of the screen assembly.

In one aspect, a screen assembly is provided that includes a filter medium disposed between an unperforated or solid shroud and a base pipe. Formation fluid can enter an inner passageway of the screen assembly defined by the filter medium and the base pipe. The filter medium can be coupled to the base pipe such that the formation fluid must cross the filter medium to enter an outer passageway defined by the filter medium and the unperforated shroud. The formation fluid can enter an inflow control device that is coupled to the screen assembly by passing through the outer passageway and entering an inlet in the inflow control device. The formation fluid can exit the inflow control device through an opening in the inflow control device that corresponds to an opening in the base pipe of the screen assembly. The opening in the base pipe can provide access to a tubing assembly.

The inner passageway and the outer passageway can have equal restriction such that the formation fluid can travel through the filter medium at any point along the length of the filter medium. The equal restriction of the inner passageway and the outer passageway can encourage an even distribution of particulate materials flowing across the length of the filter medium. An even distribution of particulate materials flowing across the length of the filter medium can lower the velocity of the particulate materials flowing across any particulate portion of the filter medium. An even distribution of particulate material flowing across the filter medium along the length of the filter medium can prevent damage to the filter medium. For example, an even distribution of particulate material flowing across the length of the filter medium can prevent erosion of the filter medium caused by the majority of particulate materials passing through a small length of the filter medium at a high velocity.

The filter medium can include a mesh layer disposed between a two perforated shrouds. In other aspects, the filter medium is a multiple layer mesh screen, a wire wrapped screen, a prepack screen, a ceramic screen, a fluid porous, particulate resistant sintered wire mesh screen, or a fluid porous, particulate resistant diffusion bonded wire mesh screen.

These illustrative examples are given to introduce the reader to the general subject matter discussed here and are not intended to limit the scope of the disclosed concepts. The following sections describe various additional features and examples with reference to the drawings in which like numerals indicate like elements, and directional descriptions are used to describe the illustrative aspects but, like the illustrative aspects, should not be used to limit the present disclosure.

FIG. 1 depicts a well system 100 with screen assemblies 114 according to certain aspects of the present disclosure. The well system 100 includes a bore that is a wellbore 102 extending through various earth strata. The wellbore 102 has a substantially vertical section 104 and a substantially horizontal section 106. The substantially vertical section 104 and the substantially horizontal section 106 may include a casing string 108 cemented at an upper portion of the substantially vertical section 104. The substantially horizontal section 106 extends through a hydrocarbon bearing subterranean formation 110.

A tubing string 112 extends from the surface within wellbore 102. The tubing string 112 can provide a conduit for formation fluids to travel from the substantially horizontal section 106 to the surface. Screen assemblies 114 and production tubular sections 116 in various production intervals adjacent to the formation 110 are positioned in the tubing string 112. On each side of each production tubular section 116 is a packer 118 that can provide a fluid seal between the tubing string 112 and the wall of the wellbore 102. Each pair of adjacent packers 118 can define a production interval.

The screen assemblies 114 associated with production tubular sections 116 can allow fluids to flow through the screen assemblies 114, but prevent particulate matter of sufficient size from flowing through the screen assemblies 114. The screen assemblies 114 can be coupled to an inflow control device such that formation fluid is filtered by the screen assembly 114 prior to entering the inflow control device.

Although FIG. 1 depicts screen assemblies 114 positioned in the substantially horizontal section 106, the screen assemblies 114 (and production tubular sections 116) according to various aspects of the present disclosure can be located, additionally or alternatively, in the substantially vertical section 104. Furthermore, any number of the screen assemblies 114, including one, can be used in the well system 100 generally or in each production interval. In some aspects, the screen assemblies 114 can be disposed in simpler wellbores, such as wellbores having only a substantially vertical section.

Figure 2:
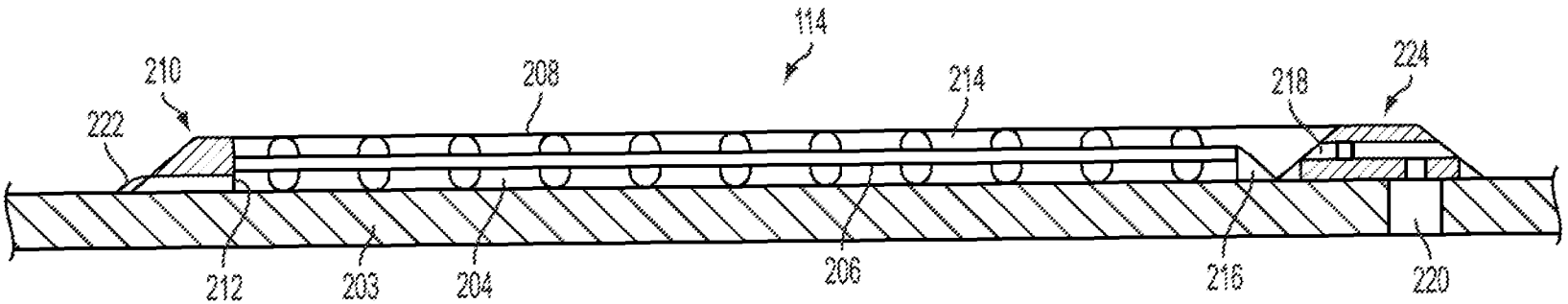
FIG. 2 is a cross-sectional side view of a screen assembly coupled to an inflow control device according to one aspect.

FIG. 2 depicts a cross-sectional side view of a screen assembly 114 according to one aspect. The screen assembly 114 may be located in a horizontal section of a wellbore, or in deviated or vertical wellbores. The screen assembly 114 includes a base pipe 203 and a filter medium 206 positioned between an unperforated shroud 208 and the base pipe 203. The unperforated shroud 208 and the filter medium 206 can be coupled to the base pipe 203 at a first end 210 of the screen assembly 114 by an end ring with welding or another type of coupling mechanism. The filter medium 206 can be coupled at a second end 216 to the base pipe 203. The filter medium 206 and the base pipe 203 define an inner passageway 204. The filter medium 206 and the unperforated shroud 208 define an outer passageway 214.

Formation fluid can enter the inner passageway 204 from the formation through an opening 212 at the first end 210 of the screen assembly 114. The first end 210 includes a pre-filter 222 that filters the formation fluid prior to the formation fluid passing through opening 212. In other aspects, the screen assembly 114 does not include the pre-filter 222. Formation fluid can pass from the inner passageway 204 through the filter medium 206, which can filter the fluid, at any point along the length of the filter medium 206. Formation fluid can pass through the filter medium 206 before entering the outer passageway. The inner passageway 204 and the outer passageway 214 can have equal restriction such that formation fluid following a path of least resistance can pass from the inner passageway 204 into the outer passageway 214 at any point along the filter medium 206. The equal restriction between the inner passageway 204 and the outer passageway 214 can cause less fluid to pass through the second end 216 of the filter medium 206 proximate to an inflow control device 224.

The inflow control device 224 is located proximate to the second end 216 of the filter medium such that formation fluid can flow from the outer passageway 214 to the inflow control device 224. Formation fluid can enter the inflow control device 224 from the outer passageway 214 through an inlet 218. Formation fluid can pass from the inflow control device 224 through an opening 220 in the base pipe 203 and into an inner area of the base pipe 203. In some aspects, the base pipe 203 is a tubing string. In other aspects, there is no inflow control device proximate to the screen assembly.

Figure 3:
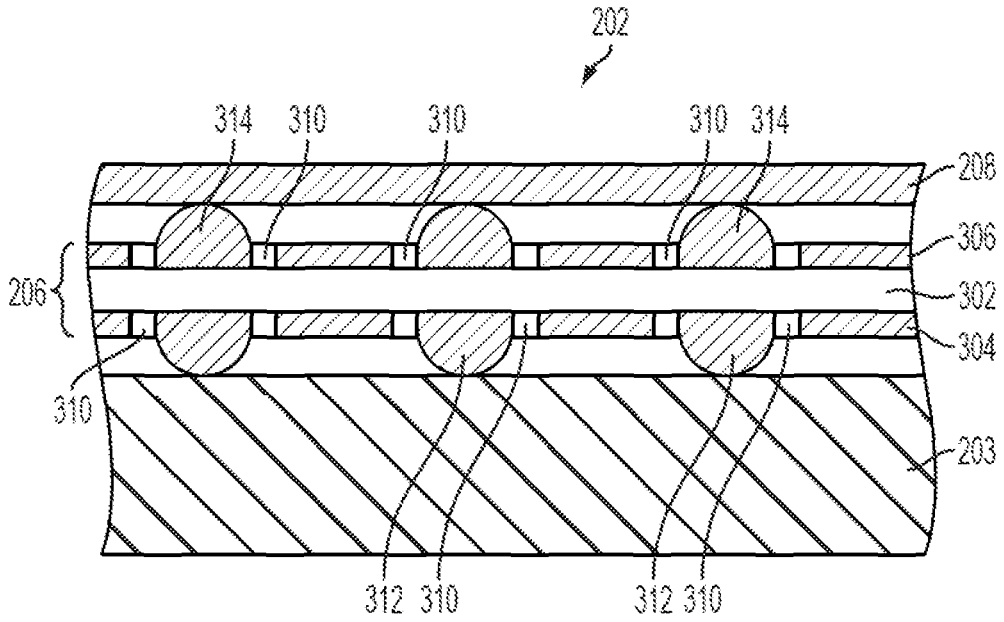
FIG. 3 is a cross-sectional side view of part of the screen assembly from FIG. 2 according to one aspect.

FIG. 3 depicts a cross-sectional side view of part of the screen assembly 114 according to one aspect. The screen assembly 114 depicted in FIG. 3 includes the filter medium 206 disposed between the base pipe 203 and the unperforated shroud 208. In one aspect, the filter medium 206 includes a mesh layer 302 disposed between a first perforated shroud 304 and a second perforated shroud 306. In other aspects, the filter medium 206 can be a single layer mesh screen, a multiple layer mesh screen, a wire wrapped screen, a prepack screen, a ceramic screen, a fluid porous, particulate resistant sintered wire mesh screen, or a fluid porous, particulate resistant diffusion bonded wire mesh screen.

Formation fluid can pass through first perforated shroud 304 and enter the mesh layer 302 via the perforations 308. Formation fluid can pass from the mesh layer 302 through the second perforated shroud 306 via the perforations 310. The first perforated shroud 304 includes protrusions 312. The protrusions 312 can provide a consistent annular gap between the base pipe 203 and the first perforated shroud 304. The protrusions 312 can also guide the fluid to pass through the filter medium 206 at various points along the length of the filter medium 206. For example, the protrusions 312 located proximate to a first end of the filter medium 206 can guide fluid to flow through the filter medium 206 proximate to the first end. Guiding fluid to flow through the filter medium 206 proximate to the first end can reduce the flow rate of fluid flowing through the filter medium 206 proximate to a second end of the filter medium 206. The second perforated shroud 306 includes protrusions 314. The protrusions 314 can provide a consistent annular gap between the second perforated shroud 306 and the unperforated shroud 208. The protrusions 312 and 314 are spherical in shape. In other aspects, the protrusions 312 and 314 can be conical or other shapes. In other aspects, one or both of the first perforated shroud 304 and second perforated shroud 306 may not include the protrusions 312 and 314, respectively. In still yet other aspects, the unperforated shroud 208 can include protrusions.

Figure 4:
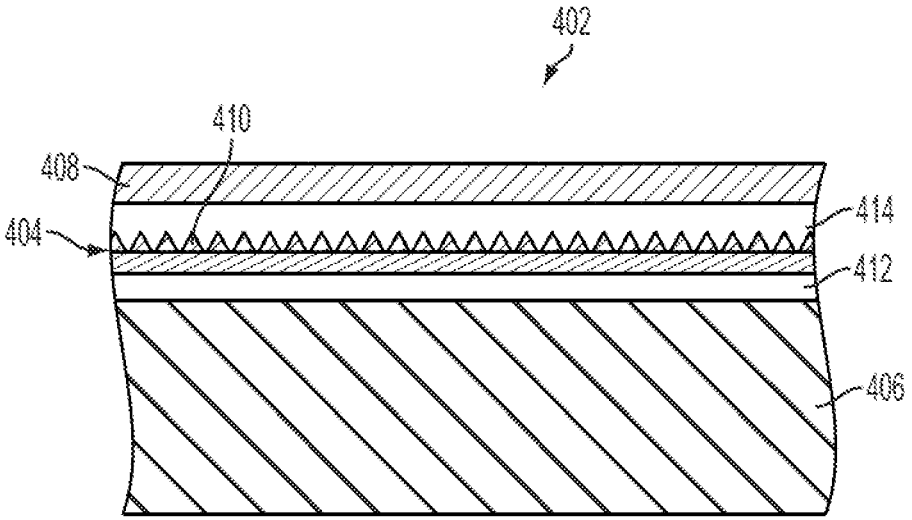
FIG. 4 is a cross-sectional side view of part of a screen assembly according to another aspect.

FIG. 4 depicts a cross-sectional side view of a portion of a screen assembly 402 according to another aspect. The screen assembly 402 includes a filter medium 404 disposed between a base pipe 406 and an unperforated shroud 408. An inner passageway 412 is defined by the filter medium 404 and the base pipe 406. An outer passageway 414 is defined by the filter medium 404 and the unperforated shroud 408. The filter medium 404 can be coupled at a first end to the base pipe 406 by an end ring or other suitable means such that formation fluid can enter the inner passageway 412. The filter medium 404 can be coupled to the base pipe at a second end such that formation fluid can pass from the inner passageway 412 to the outer passageway 414 through the filter medium 404. Formation fluid can be filtered by the filter medium 404 as the formation fluid passes from the inner passageway 412 to the outer passageway 414. The inner passageway 412 and the outer passageway 414 can have equal restriction such that the formation fluid following a path of least resistance can travel through the filter medium 404 at any point along the length of the filter medium 404. An inflow control device can be coupled to the screen assembly 402 such that formation fluid can pass from the outer passageway 414 into the inflow control device.

The filter medium 404 depicted in FIG. 4 is an inverted keystone shaped wire wrapped screen, though in other aspects other suitable material can be used to create the filter medium 404. The filter medium 404 can be positioned with the pointed end 410 of the filter medium 404 adjacent to the unperforated shroud 408. The pointed end 410 of the wire wrapped screen can provide a consistent annular gap between the filter medium 404 and the unperforated shroud 408. A consistent annular gap between the filter medium 404 and the unperforated shroud 408 can aid in fluid flow through the filter medium 404 along the length of the filter medium 404.

In one aspect, a sand control screen assembly can include a base pipe and an unperforated shroud. The assembly can also include a filter medium positioned between the unperforated shroud and the base pipe. The base pipe and the filter medium can define an inner passageway for fluid flow along the base pipe. The filter medium and the unperforated shroud can define an outer passageway for fluid flow between the filter medium and the unperforated shroud.

In another aspect, a system for use in a wellbore can include a base pipe that includes a flow control element. The system can also include a sand screen positioned around the base pipe that allows fluid to enter the sand screen and be filtered prior to entering the flow control element. The sand screen can include an unperforated shroud and a filter medium. The filter medium can be coupled to the base pipe to define an inner passageway that allows fluid to enter the inner passageway at a first end. The sand screen can also include an outer passageway defined by the filter medium and the unperforated shroud. The outer passageway can define a flow path for fluid flow to the flow control element. The filter medium can include protrusions that extend between the filter medium and the base pipe and define a consistent annular gap between the filter medium and the base pipe.

In another aspect, a sand control screen assembly includes an inner passageway and an outer passageway. The inner passageway defines a flow path between a base pipe and a filter medium. The outer passageway defines a flow path between the filter medium and an unperforated shroud. The inner passageway and the outer passageway can each have equal restriction such that the formation fluid passes from the inner passageway through the filter medium into the outer passageway at any point along the length of the filter medium.

The foregoing description of the aspects, including illustrated aspects, of the disclosure has been presented only for the purpose of illustration and description and is not intended to be exhaustive or to limit the disclosure to the precise forms disclosed. Numerous modifications, adaptations, and uses thereof will be apparent to those skilled in the art without departing from the scope of this disclosure.

What is claimed is:

1. A sand control screen assembly operably positionable within a wellbore, the sand control screen assembly comprising:

a base pipe;

an unperforated shroud;

a filter medium positioned between the unperforated shroud and the base pipe and extending along a length of the base pipe, the filter medium and the base pipe defining an inner passageway for fluid flow along the base pipe, the filter medium and the unperforated shroud defining an outer passageway for fluid flow between the filter medium and the unperforated shroud, wherein the base pipe is unperforated along the length of the base pipe defining the inner passageway for fluid flow along the base pipe.

2. The sand control screen assembly of claim 1, wherein the unperforated shroud and the filter medium are coupled to the base pipe at a first end of the sand control screen assembly by an end ring, the end ring including an opening for allowing formation fluid to pass from a source to the inner passageway.

3. The sand control screen assembly of claim 2, wherein the first end of the sand control screen assembly includes a pre-filter positioned proximate to the end ring.

4. The sand control screen assembly of claim 1, wherein the filter medium includes a mesh layer disposed between a first perforated shroud and a second perforated shroud and at least one of the first perforated shroud or the second perforated shroud includes a plurality of protrusions.

5. The sand control screen assembly of claim 4, wherein the plurality of protrusions are periodically spaced along a length of at least one of the first perforated shroud and the second perforated shroud.

6. The sand control screen assembly of claim 5, wherein the plurality of protrusions are spherically shaped.

7. The sand control screen assembly of claim 5, wherein the plurality of protrusions define a consistent annular gap between at least one of the first perforated shroud and the base pipe and the second perforated shroud and the base pipe.

8. The sand control screen assembly of claim 1, further comprising an inflow control device coupled to the base pipe at a second end of the sand control screen assembly, the inflow control device including an inlet for receiving formation fluid from the outer passageway.

9. The sand control screen assembly of claim 1, wherein the filter medium is selected from the group consisting of a single layer mesh screen, a multiple layer mesh screen, a wire wrapped screen, a prepack screen, a ceramic screen, a fluid porous, particulate resistant sintered wire mesh screen, and a fluid porous, particulate resistant diffusion bonded wire mesh screen.

10. The sand control screen assembly of claim 1, wherein the filter medium includes a plurality of protrusions extending between the filter medium and at least one of the base pipe or unperforated shroud.

11. The sand control screen assembly of claim 10, wherein the plurality of protrusions define an annular gap between the filter medium and at least one of the base pipe or unperforated shroud.

12. A system for use in a wellbore, comprising:

a base pipe including at least one flow control element; and a sand screen including an unperforated shroud and positioned around the base pipe such that fluid is filtered by the sand screen prior to entering the at least one flow control element, the sand screen including a filter medium positioned between the unperforated shroud and the base pipe and coupled to the base pipe such that fluid enters at a first end, wherein the filter medium and the base pipe define an inner passageway, wherein the filter medium and the unperforated shroud define an outer passageway, the outer passageway defining a flow path for fluid flow to the at least one flow control element, and wherein the filter medium includes a plurality of protrusions extending between the filter medium and the base pipe for defining an annular gap between the filter medium and the base pipe.

13. The system of claim 12, wherein the plurality of protrusions are spherically shaped and extend periodically along a length of the filter medium.

14. The system of claim 12, wherein the filter medium is coupled to the base pipe at a second end such that fluid passes from the inner passageway to the outer passageway through the filter medium.

15. A sand control screen assembly comprising:

an inner passageway defining a flow path between a base pipe and a filter medium; and an outer passageway defining a second flow path between the filter medium and an unperforated shroud, the second flow path providing access to an inflow control device, wherein the inner passageway and the outer passageway have equal restriction for guiding formation fluid such that the formation fluid entering the sand control screen assembly passes from the inner passageway through the filter medium into the outer passageway at any point along a length of the filter medium.

16. The sand control screen assembly of claim 15, wherein the filter medium comprises a mesh layer disposed between a first perforated shroud and a second perforated shroud.

17. The sand control screen assembly of claim 15, wherein the unperforated shroud and the filter medium are coupled to the base pipe at a first end of the sand control screen assembly by an end ring, the end ring including an opening through which formation fluid can enter the inner passageway.

18. The sand control screen assembly of claim 17, further comprising a pre-filter proximate to the end ring.

19. The sand control screen assembly of claim 15, wherein the filter medium is selected from the group consisting of a single layer mesh screen, a multiple layer mesh screen, a wire wrapped screen, a prepack screen, a ceramic screen, a fluid porous, particulate resistant sintered wire mesh screen, and a fluid porous, particulate resistant diffusion bonded wire mesh screen.

20. The sand control screen assembly of claim 15, wherein the inflow control device includes an inlet through which formation fluid can enter, and an opening through which formation fluid can pass from the inflow control device through a corresponding opening in the base pipe into a production tubing.

* * * * *